US006881479B2

(12) United States Patent
Vancraeynest

(10) Patent No.: US 6,881,479 B2
(45) Date of Patent: Apr. 19, 2005

(54) REINFORCEMENT FIBER BUNDLE AND PRODUCTION METHOD OF SUCH REINFORCEMENT FIBER BUNDLE

(75) Inventor: Yves Maurits Renë Vancraeynest, Zwevegem (BE)

(73) Assignee: N. V. Bekaert S.A., Zwevegem (BE)

( * ) Notice: Subject to any disclaimer, the term of this patent is extended or adjusted under 35 U.S.C. 154(b) by 0 days.

(21) Appl. No.: 10/433,472

(22) PCT Filed: Dec. 6, 2001

(86) PCT No.: PCT/EP01/14482

§ 371 (c)(1),
(2), (4) Date: Jun. 10, 2003

(87) PCT Pub. No.: WO02/48476

PCT Pub. Date: Jun. 20, 2002

(65) Prior Publication Data

US 2004/0028898 A1 Feb. 12, 2004

(30) Foreign Application Priority Data

Dec. 13, 2000 (NL) ..... 1016864

(51) Int. Cl.[7] ..... D02G 3/00
(52) U.S. Cl. ..... 428/378; 428/375; 428/392
(58) Field of Search ..... 428/378, 375, 428/392, 34.4, 36.9

(56) References Cited

U.S. PATENT DOCUMENTS

| | | | |
|---|---|---|---|
| 4,224,377 | A | 9/1980 | Moens |
| 5,091,255 | A | 2/1992 | Hsu et al. |
| 5,897,928 | A | 4/1999 | Sanders et al. |

FOREIGN PATENT DOCUMENTS

| | | |
|---|---|---|
| BE | 1003656 | 5/1992 |
| EP | 05575617 | 9/1993 |
| WO | WO 96/02715 | 2/1996 |
| WO | WO 00/49211 | 8/2002 |

*Primary Examiner*—Rena Dye
*Assistant Examiner*—J. M. Gray
(74) *Attorney, Agent, or Firm*—Shlesinger, Arkwright & Garvey LLP

(57) ABSTRACT

A reinforcement fiber bundle and method for joining reinforcement fibers to reinforcement fiber bundles for reinforcement wherein a curable material is provided in which reinforcement fibers are bundled in a substantially parallel position and at least at the ends are joined, in which at least the ends of the reinforcement fibers are joined by means of an adhering substance that is substantially inert in relation to the non-cured curable material and that, when the reinforcement fiber bundles are mixed with at least the curable material, loses its cohesion.

18 Claims, 3 Drawing Sheets

REINFORCEMENT FIBER BUNDLE AND PRODUCTION METHOD OF SUCH REINFORCEMENT FIBER BUNDLE

FIELD OF THE INVENTION

The present invention relates, in a first aspect, to a reinforcement fiber bundle, comprising a number of substantially parallel reinforcement fibers for reinforcing a curable material, which reinforcement fibers are joined at least at the ends thereof by means of an adhering substance, which loses its cohesion under the influence of mechanical forces during mixing of the reinforcement fibers bundles with at least the curable material.

BACKGROUND OF THE INVENTION

Such reinforcement fiber bundle is known from WO-A-00/49211. In this document, reinforcement fibers for castable compositions such as concrete, are bundled and joined at the ends by means of a layer of binding material applied on the ends. The binding material is either dissolved by the castable composition or dispersible in the aggregates therein. As a result, the bundle disintegrates and the fibres are liberated.

Such reinforcement fiber bundle has the disadvantage that the binding material that is dissolved or dispersed is absorbed by the material that has to be cast or cured. As the aforementioned reinforcement fiber bundle is meant to increase the ratio of reinforcement fibers to the curable material, a considerable quantity of binding material will be dissolved or dispersed in the curable material. This entails the risk that the properties of the curable material are adversely influenced. Therefore, there is need for a reinforcement fiber bundle of which a large part of the reinforcement fibers can be integrated in the curable material without adding substances that become dissolved or dispersed in or react with the curable material.

OBJECTS AND SUMMARY OF THE INVENTION

The invention intends to solve the aforementioned problem and thereto is characterized in that the adhering substance substantially comprises a material which is substantially inert with respect to the non-cured curable material.

By "inert with respect to the non-cured curable material" the present application understands that the adhering substance substantially does not react with the conventional curable materials that still have to be cured or with mixtures of such materials, regardless of the fact whether conventional additives are added or not. More particularly, the adhering substance is substantially non-soluble in water and/or organic solvents.

When the reinforcement fiber bundles are mixed with the curable material, the adhering substance may lose its cohesion in many ways. A temperature treatment e.g. can cause the adhering substance to fall apart into smaller pieces. Moreover, the aforementioned mechanical forces appear e.g. by friction of the reinforcement fiber bundles with other reinforcement fiber bundles, the walls of the recipient, the mixing means, gravel that may be present in the curable material, etc. Because of these mechanical forces during the mixing process, the adhering substance will be divided into ever-smaller pieces till the reinforcement fibers are no longer joined and can be spread separately in curable material.

Preferably, the adhering substance is a curing substance. Such substance may be applied in a viscous condition on the reinforcement fibers, and be subsequently cured by drying, heating, etc. In principle, however, it is also possible to use a non-curing substance as adhering substance, provided the appropriate and/or sufficiently large mechanical forces are applied. It is e.g. possible to choose a tenacious adhering substance, in combination with which e.g. moving knives guarantee that the cohesion of the adhering substance is lost and that the reinforcement fibers are separated.

Preferably, the adhering substance substantially comprises the curable material. In that way, it is extremely efficiently ensured that the properties of the curable material will be very little or not influenced by the adhering substance. The finally cured curable material will be a homogeneous material, apart from the reinforcement fibers, which have been spread in the meantime. It is possible that one or more appropriate additive substances are added to the curable material, or that the mixing ratios of the components of the concrete mixture differ slightly for the adhering substance and the curable material. It is however possible to choose different materials for the adhering substance and the curable material.

Although preferably the adhering substance substantially comprises the curable material, it may comprise widely used additives. E.g. a small amount of a material that promotes abrassion, or otherwise influences mechanical properties of the adhering substance, may be added.

Advantageously, the adhering substance substantially comprises mortar, concrete, gypsum, cement or a mixture thereof. These adhering substances are particularly suitable for use in concrete or concrete-like materials. These curable materials are very widely used as e.g. building materials. They are very strong, but also relatively brittle. To improve their strength, and especially their fracturing behavior, these materials are often reinforced by means of reinforcement fibers. The use of adhering substances according to the invention ensures that the basic matrix of the final concrete or concrete-like material is substantially unaltered. The proposed adhering substances very much resemble concrete-like materials. It is to be noted, however, that, if gypsum is used, the gypsum should be used in a low concentration, such that e.g. the curing time and other features of the concrete are not influenced negatively.

In a particularly advantageous embodiment of the invention the adhering substance comprises secondary reinforcement fibers. By adding such secondary reinforcement fibers to the adhering substance, the latter has a larger strength and malleability. This allows to efficiently use an adhering substance that per se does not have sufficient mechanical strength as adhering substance. As the mechanical strength of the adhering substance has been increased with secondary reinforcement fibers, the bulk storage, and the transport and pour-out behavior of the reinforcement fiber bundles can be improved.

In principle, the secondary reinforcement fibers can be made of any material, though they preferably comprise glass fibers or polypropene fibers with a maximum diameter of 100 $\mu$m. Such fibers are efficient and it is not difficult to manufacture the desired diameter.

Advantageously, the length-diameter ratio of the reinforcement fiber bundles is at least 0.2 and maximally 5. Such length-diameter properties ensure good manageability and pour-out properties out of storage silos of reinforcement fiber bundles. If the length-diameter ratio exceeds the aforementioned range, the risk of bridging in storage silos increases. Nevertheless, reinforcement fiber bundles of which the length-diameter ratio exceeds the aforementioned range, can be used under particular conditions. More advantageously, the length-diameter ratio of the reinforcement fiber bundles is at least 0.5 and maximally 1.5. In the event of such length-diameter ratio, the reinforcement fiber bundles substantially resemble a cylinder or block, resulting in very good pour-out properties and excellent manageability. Preferably, the length-diameter ratio of the reinforcement fiber bundles substantially amounts to 1.

The reinforcement fiber bundle can have any shape, though it is preferably substantially cylindrical. In the case of a cylindrical shape, the reinforcement fiber bundles have no or practically no corners and/or tips, ensuring even better manageability and pour-out properties. Nevertheless, other shapes are also possible, such as cubes or blocks. In the ideal case, fibers of different lengths are used, with the shortest fibers at the outer contour of the reinforcement fiber bundle and the longest fibers in the middle, thus creating a practically spherical reinforcement fiber bundle.

In principle, the reinforcement fibers that are used can have any desired length-diameter ratio. Preferably, the length-diameter ratio of the reinforcement fibers is at least 40.

In an advantageous embodiment of the reinforcement fiber bundle according to the invention, the reinforcement fibers are made of steel with a tensile strength between 500 and 3000 $N/mm^2$. It is also possible to choose steel with another tensile strength, but this offers little advantages when reinforcing the curable material. But, it may also be efficient to choose other materials for the reinforcement fibers, such as e.g. carbon fibers, polypropene or other plastics, glass, etc.

Preferably, the ends of the reinforcement fibers are hook-shaped. In this application, the term "hook-shaped ends" not only refers to fibers being bent at least once at their ends. It is also refers to fibers having ends which are deformed, such that in at least one direction the diameter of the projection of the deformed end onto a plane perpendicular to a main axis of the reinforcement fiber is larger than the diameter of that section of the fiber between the ends. For example, the ends may be flattened, bent or tortuous, or may have the shape of a nail, and so on. This will be elucidated in the drawings. This improves the adherence of the reinforcement fibers in the curable material after curing. In the case of straight reinforcement fibers, it is more likely that these fibers will be pulled out of the cured material when a fracture arises, as a result of which the strength of the material is lost. But, there are also other ways to improve the adherence of the reinforcement fibers in the cured curable material, e.g. by flattening the fibers or giving them a corrugated or hook-shaped aspect.

Preferably, the reinforcement fiber bundle according to the invention comprises end faces, which are substantially evenly covered by the adhering substance. So, the end faces of the reinforcement fiber bundles are substantially smooth. This offers the advantage of decreased clewing between the reinforcement fiber bundles. Ordinarily the ends of the reinforcement fibers can be entangled in the ends of the reinforcement fibers of other reinforcement fiber bundles, or also (in the middle) between the reinforcement fibers of other reinforcement fiber bundles. By evenly covering the ends of the reinforcement fibers with the adhering substance this is avoided in an efficient way.

It is also possible that the adhering substance is applied to other or additional parts of the reinforcement fiber bundle. The entire reinforcement fiber bundle can e.g. be surrounded by or even saturated with the adhering substance. It is also possible to put a ring of adhering substance between the ends of the reinforcement fiber bundle. This ensures an even larger mechanical strength and an even smaller interaction between the reinforcement fiber bundles, though the treatment time will increase.

In a preferential embodiment of the reinforcement fiber bundle according to the invention, substantially only the hook-shaped ends of the reinforcement fibers are comprised in the adhering substance. In that way it is still ensured that the hook-shaped ends do not contribute to clewing of the reinforcement fiber bundles, whereas only a very small quantity of adhering substance is used. Generally it is important to use as little a quantity of adhering substance as possible since it may adversely affect the curable material. This quantity may be further minimized by good alignment of the reinforcement fibers in the bundle. Thus the fiber ends will all be present in as small disk as possible.

The invention also relates to a method for joining reinforcement fibers into reinforcement fiber bundles for reinforcing a curable material, in which reinforcement fibers are bundled in a substantially parallel position and are joined at least at the ends, in which the reinforcement fibers are joined by applying to at least the ends of the reinforcement fiber bundle an adhering substance which is substantially inert in relation to the non-cured curable material and which, under the influence of the mechanical forces during the mixing of the reinforcement fiber bundles with at least the curable material, loses its cohesion.

Such a method provides in a simple way reinforcement fiber bundles according to the invention with very good manageability and pour-out properties without the adhering substance having a negative influence on the properties of the curable material. Nevertheless, it is also possible to apply the fibers in a quantity of adhering substance, manually or by means of a "fiber gun" that "shoots" or pricks the fibers in the adhering substance, etc.

In a preferential embodiment, a curing adhering substance is applied and subsequently cured. This can be obtained by exposing the reinforcement fiber bundles to which the adhering substance is applied to a curing treatment, e.g. air-drying, an increased temperature or a polymerization reaction.

In another preferred method the substantially parallel bundling of the reinforcement fibers takes place under tension. The advantage is that the distribution of the reinforcement fibers in the curable material is much better when the adhering substance comes off.

The invention also relates to a reinforcement fiber bundle, comprising a number of substantially parallel reinforcement fibers for reinforcing a curable material, which reinforcement fibers are joined at least at the ends thereof by means of an adhering substance which loses its cohesion during the mixing of the reinforcement fiber bundles with at least the curable material, wherein the adhering substance comprises reinforcement fibers.

The use of secondary reinforcement fibers in the adhering substance is not limited to adhering substances that are inert with respect to the curable material. The advantage of adding secondary reinforcement fibers, viz. the larger strength and malleability of the adhering substance, as described above, is obtained also in e.g. water-soluble adhering substances. E.g. the adhering substance may comprise polyvinylacetate, either as a main constituent, or as an additive to for example a mortar-like adhering substance. In these cases, the adhering substance becomes much more flexible, and either completely, or at least more water-soluble. Other water-soluble constituents are possible.

On the other hand, the mentioned limitations and advantages of preferred embodiments of the reinforcement fiber bundle according to the first aspect of the invention also hold for the reinforcement fiber bundle according to claim 18.

A first embodiment is characterized in that the secondary reinforcement fibers comprise glass fibers and/or polypropene fibers with a diameter of maximally 100 micrometer.

In a second embodiment at least the ends of the reinforcement fibers are substantially evenly covered with the adhering substance.

Expediently, the ends of the reinforcement fibers are hook-shaped.

In a third embodiment, the thickness of the applied adhering substance substantially corresponds to the length of the hook-shaped ends of the reinforcement fibers.

In a fourth embodiment, the length-diameter ratio of the reinforcement fiber bundle is at least 0.2 and maximally 5, more preferably at least 0.5 and maximally 1.5. Expediently, the reinforcement fiber bundle is substantially cylindrical.

In a fifth embodiment, the length-diameter ratio of the reinforcement fibers is at least 40.

The reinforcement fibers may be made of steel with a tensile strength between 500 and 3000 N/mm$^2$.

The present invention also relates, in another aspect thereof, to a reinforcement fiber bundle, comprising a number of substantially parallel reinforcement fibers for reinforcing a curable material, which reinforcement fibers are joined at least at the ends thereof by means of an adhering substance which loses its cohesion during the mixing of the reinforcement fiber bundles with at least the curable material, wherein the ends of the reinforcement fibers are hook-shaped and that the reinforcement fiber bundle comprises end faces which are substantially evenly covered with the adhering substance. The advantage of the end faces of the reinforcement fiber bundle being substantially evenly covered with the adhering substance is not limited to any kind of adhering substance, be it with or without secondary reinforcement fibers. Especially with hook-shaped ends there is a large risk of entanglement of reinforcement fiber bundles, and hence of bridging in silos. By covering the end faces smoothly, the reinforcement fiber bundles are no longer able to become entangled in other fiber bundles. This also holds for separate reinforcement fibers already liberated in the curable material. It is noted here that this latter effect forms a much more severe problem with reinforcement fibers with hook-shaped ends than with reinforcement fibers with straight ends.

Again, the limitations and advantages of the preferred embodiments of the reinforcement fiber bundle according to the first aspect of the invention also hold for the reinforcement fiber bundle as mentioned in this third aspect of the invention.

In a first embodiment of the reinforcement fiber bundle according to the third aspect of the invention, substantially only the hook-shaped ends of the reinforcement fibers are comprised in the adhering substance.

In a second embodiment the adhering substance is substantially inert with respect to the non-cured curable material.

Advantageously, the adhering substance is a curing substance.

Preferably, the adhering substance substantially comprises the curable material.

More advantageously, the adhering substance substantially comprises mortar, concrete, gypsum, cement or a mixture thereof.

In a third embodiment, the adhering substance comprises secondary reinforcement fibers.

Advantageously, the secondary reinforcement fibers comprise glass fibers and/or polypropene fibers with a diameter of maximally 100 micrometer.

In a fourth embodiment, the length-diameter ratio of the reinforcement fiber bundle is at least 0.2 and maximally 5, more preferably at least 0.5 and maximally 1.5. Even more preferably, the reinforcement fiber bundle is substantially cylindrical.

Advantageously, the length-diameter ratio of the reinforcement fibers is at least 40.

Preferably, the reinforcement fibers are made of steel with the tensile strength between 500 en 3000 N/mm$^2$.

BRIEF DESCRIPTION OF THE DRAWINGS

With reference to the accompanying drawing, the invention will be further explained into detail. In this drawing.

DETAILED DESCRIPTION OF THE PREFERRED EMBODIMENTS

Figure 1:
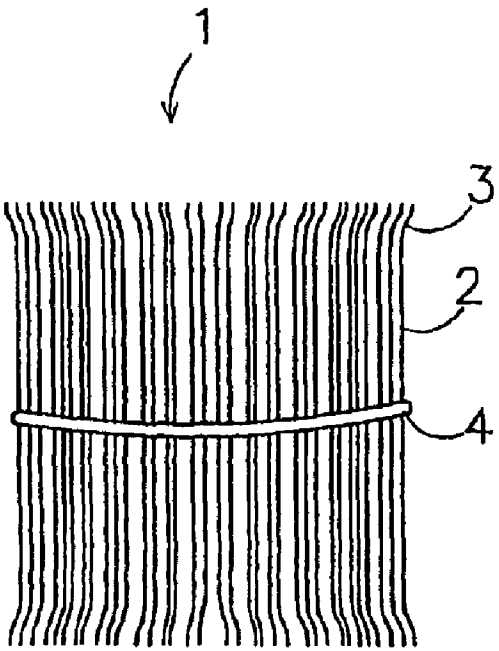
FIG. 1 represents a bundle of reinforcement fibers that are not joined yet.

In FIG. 1, a reinforcement fiber bundle is generally indicated by 1. The reinforcement fiber bundle 1 is made up of a large number of parallel reinforcement fibers 2 with a hook-shaped end 3. The reinforcement fibers 2 are kept together by means of a thread 4.

Although the reinforcement fibers 2 are represented with hook-shaped ends 3, they can in principle have any appropriate shape according to the intended application.

The reinforcement fibers 2 can be made of any kind of materials, depending on the requirements made upon the fibers and upon the curable material that has to be reinforced and in which the fibers will be used. In the event of curable materials to be reinforced, we think of e.g. synthetic resins, concrete and the like. The material of which the reinforcement fibers are made can e.g. be glass, quartz, carbon or plastics. For concrete and concrete-like materials to be reinforced, it is recommended to preferably use metal reinforcement fibers. In most cases, steel types with a high tensile strength, e.g. between 500 and 3000 N/mm$^2$ are used.

The fibers may be straight, this is a cheap and simple realization of reinforcement fibers. Preferably, the reinforcement fibers have a shape that renders it more difficult for the reinforcement fibers to slide out of the cured material under the influence of a tensile load. Therefore, the fibers are e.g. corrugated or their cross-sectional surface varies over their length. In FIG. 1, the reinforcement fibers have hook-shaped ends. With such a shape, the fibers have to be deformed completely before they can be pulled out of the concrete or other material used.

The length-diameter ratio of the used reinforcement fibers is, because of practical and economic reasons, mostly comprised between 10 and 200, and preferably at least 40. In the case of non-straight fibers, the length is the straight-lined distance between the ends of the fiber, whereas in the case of fibers of which the diameter varies over the entire length, the diameter is determined as the average diameter over the entire length.

A reinforcement fiber bundle can consist of a variable number of reinforcement fibers, e.g. between 10 and 2000, depending on the desired shape of the reinforcement fiber bundle and the properties of the reinforcement fibers that are used. To keep the reinforcement fibers together until the adhering substance to be applied does so, the reinforcement fiber bundle can be equipped with temporary adhering means, such as an elastic, a thread etc., or the bundle is hugged by a clip, tongs, jaws or another mechanical device. Preferably, the temporary adhering means that are used are so designed that they can stay in position around the bundle from the moment of bundling till the application and, if necessary, the curing of the adhering substance that is to be applied later on. Afterwards, the temporary adhering means can be removed. In certain cases, e.g. when a thread or elastic is used, the temporary adhering means may stay in place. The mixing process is often so intensive that the adhering means are completely destructed mechanically. Preferably, these complementary adhering means are inert in relation to the curable material. It is e.g. possible to use a thread that is made of the same material as the reinforcement fibers, in which event the diameter of the thread is smaller or in which thread a weak spot has been made, so as to allow the thread to break during the mixing process of the reinforcement fiber bundles with the curable material and to allow the reinforcement fibers to be liberated from the reinforcement fiber bundle.

Preferably, the additional adhering means are chosen in such a way that the reinforcement fibers 2 of the reinforcement fiber bundle 1 are kept together under tension. It is e.g. possible to use a tight elastic or a tight metal thread as additional adhering means. After mixing with the curable material and the crumbling of the adhering substance 5, the distribution of the reinforcement fibers 2 in the curable material will be easier.

The shape of the reinforcement fiber bundle in FIG. 1 substantially corresponds with a cylinder shape. The length-diameter ratio of the reinforcement fiber bundle approximately is 1. In the event of such shape, the reinforcement fiber bundles resemble "stones" or "coarse aggregate" and so only have a very small tendency to bridging in the storage silos. By bridging, it is understood that the bundles entwine in such a way in a storage silo that the pouring-out of the silo is stopped: the bottom non-poured out fiber bundles then form a bridge reaching from one (side of the) wall of the storage silo to the other. Although a value of approximately 1 for the length-diameter ratio of the reinforcement fiber bundle is preferred, values comprised between 0.2 and 5 can also be used.

The dimensions of the reinforcement fiber bundle are to a large degree determined by the reinforcement fibers that are used. The length of these fibers mostly ranges between 0.25 and 10 cm though other dimensions are also conceivable. The diameter of the cross-section of a reinforcement fiber bundle preferably ranges between 0.25 and 10 cm whereas other values are also possible.

Figure 2:
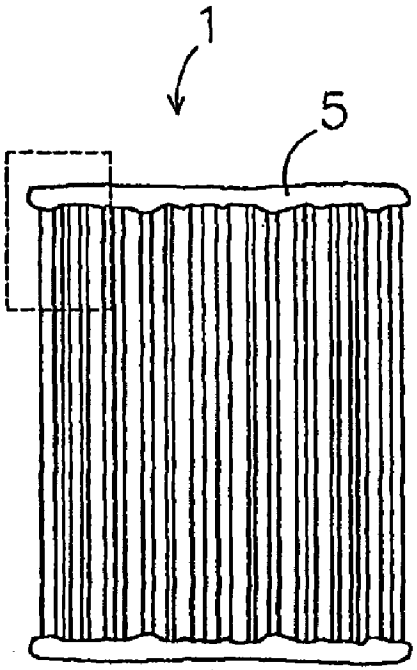
FIG. 2 shows a reinforcement fiber bundle according to the invention.

FIG. 2 shows a reinforcement fiber bundle 1 in which the ends 3 of the reinforcement fibers 2 are joined in each case by applying a layer of adhering substance 5.

Figure 3:
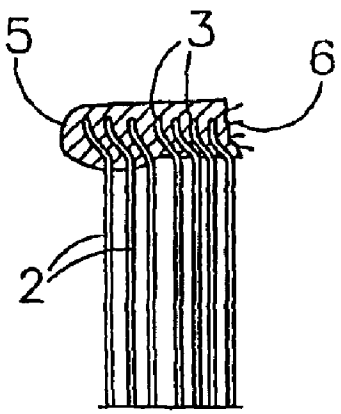
FIG. 3 shows a detail of the reinforcement fiber bundle according to FIG. 2.

FIG. 3 gives a detail of FIG. 2 in which the ends 3 of the reinforcement fibers 2 are covered with an adhering substance 5. In the adhering substance 5, there are integrated very fine polypropene secondary reinforcement fibers 6. The layer thickness of the adhering substance 5 is approximately as large as the length of the hook-shaped end 3.

It is possible to cover the sides instead of the ends 3, but covering the ends is preferred as it is in that way possible to efficiently avoid that the mostly hook-shaped ends 3 of the reinforcement fibers 2 of different reinforcement fiber bundles 1 entangle, and thus that bridging occurs in a storage silo for reinforcement fiber bundles.

The adhering substance 5 is inert in relation to the curable material to avoid that the properties of the material are negatively influenced. Preferably, the material of the adhering substance is substantially equal to the curable material, e.g. concrete. As a result, it is ensured that the properties of the final reinforced cured material are not or practically not influenced. Other adhering substances, such as several ceramic masses, are also possible.

Possible brittleness of the adhering substance 5 or its resistance to breaking under (mechanical) loads can amongst others be set by choosing the appropriate ratio of binding agent, sand and the like. Sometimes, the strength to be obtained is insufficient to ensure good transport properties, a good manageability, etc. In such event, the adhering substance can in turn be mixed with secondary reinforcement fibers 6. It is e.g. possible to embed polypropene or glass fibers, with a diameter between 0 and 100 $\mu$m, in the adhering substance. By adding such fibers, the adhering substance's tensile strength and the general resistance against breaking under mechanical load increase. So, the reinforcement fiber bundles 1 remain intact during transport, storage, etc., without having to take special measures. The secondary reinforcement fibers 6 can contribute to the improvement of the properties of the curable material.

The adherence substance 5 is applied to both sides of the fibers 2 in the reinforcement fiber bundle 1 of FIGS. 2 and 3. It is also possible that the entire reinforcement fiber bundle 1 is surrounded or even impregnated by the adhering substance 5 or that only one end of the fiber bundle 1 is covered with the adhering substance 5. But it has to be said that this is not to be preferred. You either have to use an excessive quantity of adhering substance, as a result of which the strength of the reinforcement fiber bundle 1 increases in such a way that the time during which it has to fall apart during the mixing process with the curable material excessively increases, or the ends 3 at one side of the reinforcement fibers 2 stay free, as a result of which the ends of the reinforcement fibers of the reinforcement fiber bundles 1 can entangle and so cause bridging of the reinforcement fiber bundles 1.

The adhering substance 5 can be applied by means of smearing, spraying, brushing, dipping the desired quantity, etc. In addition, the reinforcement fiber bundle 1 can be immersed or pushed in a holder with adhering substance 5 to the desired impregnation depth. Once the adhering substance is applied, it can be cured, if so desired, by drying it in the air, a heat treatment, a combination of both or in any other appropriate way.

Figure 4A:
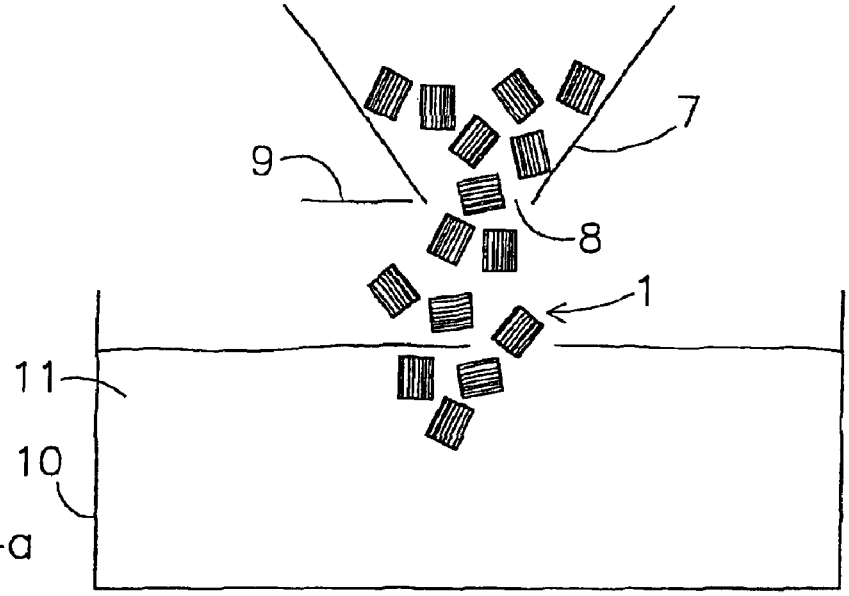
FIGS. 4*a–c* shows a schematic representation of the mixing of reinforcement fiber bundles according to the invention with the curable material.
Figure 4B:
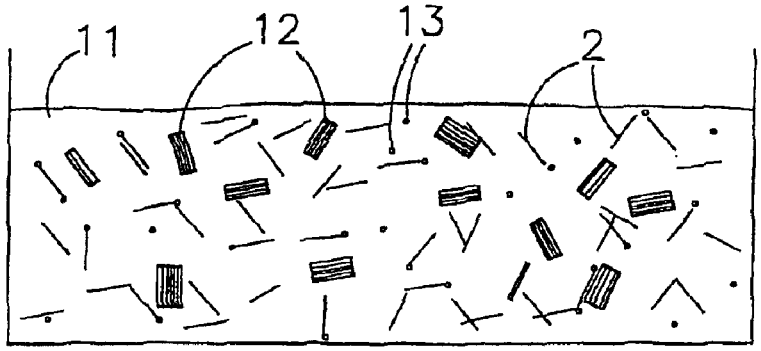
Figure 4C:
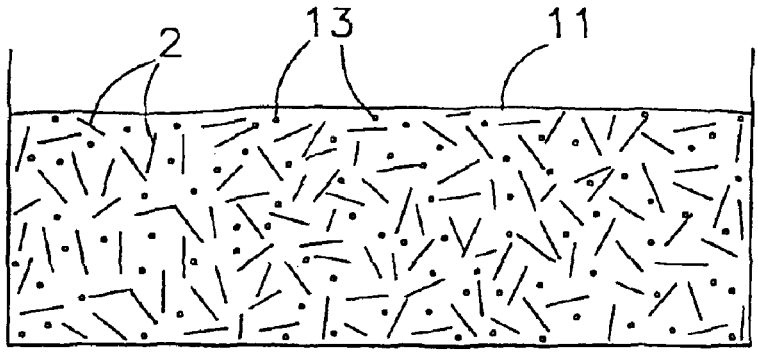

FIGS. 4*a–c* represent a method for mixing reinforcement fiber bundles according to the invention with curable material in a holder.

In FIG. 4*a* the reinforcement fiber bundles 1 are situated in a storage holder 7 with at the bottom side a lockable mouth 8 that can be opened by means of a moveable slide 9. Under the mouth 8, there is a holder 10 that contains the curable material 11. The slide 9 is opened and the reinforcement fiber bundles 1 pour out of the storage holder 7 in the curable material 11.

The reinforcement fiber bundles 1 are not always directly added to the curable material 11, as shown in FIG. 4*a*. It is also possible to first store the components of the curable material in separate storage silos and to have the exact quantities of the components flow in the holder 10. It is also possible to move the reinforcement fiber bundles 1 from the storage silos via a conveyer belt to holder 10. In such event, it is recommended to avoid bridging of the reinforcement fiber bundles 1 in the storage silo concerned.

In FIG. 4*b* the reinforcement fiber bundles 1 are already somewhat distributed amongst the curable material 11 with the help of the mixing means (not represented). This figure also shows decreased fiber bundles 12 and loose reinforcement fibers 2. Rests of adhering substance 13 stick to some loose reinforcement fibers 2, as loose rests of adhering substance 13 are also spread in the curable material.

In FIG. 4*c* all reinforcement fibers 2 are separated, while rests of adhering substance 13 are spread through the entire curable material. After curing of the curable material 11 these rests only form granules that are incorporated in the material, while, if the adhering substance 5 and the curable material 11 substantially correspond, there only remains a homogeneous material with reinforcement fibers after curing of the curable material, in which homogeneous material there can not be found any rests of adhering substance.

Figure 5A:
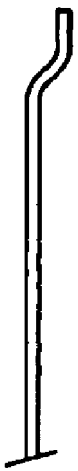
FIGS. 5*a–e* shows some examples of hook-shaped ends of fibers.
Figure 5B:
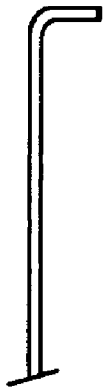
Figure 5C:
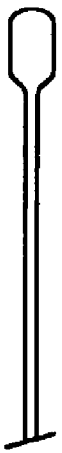
Figure 5D:
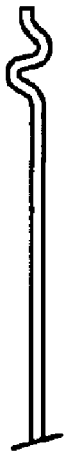
Figure 5E:
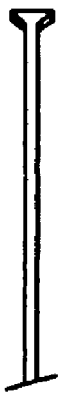

FIG. 5*a–e* shows some examples of reinforcement fibers with hook shaped ends. As mentioned above, this includes deformed ends. FIG. 5*a* shows a first hook-shaped end. FIG. 5*b* shows a second hook-shaped end. FIG. 5*c* shows a flattened end. FIG. 5*d* shows a tortuous end. FIG. 5*e* shows a head-like end.

Such ends offer superior properties as to increased tensile strength of the cured curable material. It is possible for the fibers to have one or two hook-shaped ends.

EXAMPLE

Experiments have been carried out, using the following adhering substance.

| | | |
|---|---|---|
| a) | cement | 86.52% by weight |
| b) | polyvinyl alcohol | 4.02% by weight |
| c) | water | 9.38% by weight |
| d) | polypropene fibers | 0.08% by weight |

This adhering substance resulted in excellent properties of the fiber bundles. In general, they did not break during transport, when experiencing shocks, or even when falling. Yet, during mixing with the curable material, the individual fibers were released efficiently and reliably.

What is claimed is:

1. Reinforcement fiber bundle comprising a number of substantially parallel reinforcement fibers for reinforcing a curable material said reinforcement fibers being joined at least at the ends thereof by an adhering substance which loses its cohesion under the influence of mechanical forces during mixing of the reinforcement fiber bundles with at least the curable material, wherein the adhering substance substantially comprises a material which is substantially inert with respect to the non-cured curable material, the adhering substance substantially comprising the curable material, the adhering substance substantially comprises mortar, concrete, gypsum, cement or a mixture thereof.

2. Reinforcement fiber bundle according to claim 1 wherein said adhering substance comprises secondary reinforcement fibers.

3. Reinforcement fiber bundle according to claim 2 wherein said secondary reinforcement fibers comprise at least one of glass fibers and polypropene fibers with a diameter of maximally 100 micrometers.

4. Reinforcement fiber bundle as in claim 1 and wherein the length-diameter ratio of said reinforcement fiber bundle is at least 0.2 and maximally 5.

5. Reinforcement fiber bundle as in claim 1 and wherein the length-diameter ratio of said reinforcement fiber bundle is at least 0.5 and maximally 1.5.

6. Reinforcement fiber bundle as in claim 1 and wherein said reinforcement fiber bundle is substantially cylindrical.

7. Reinforcement fiber bundle as in claim 1 and wherein said length-diameter ratio of said reinforcement fibers is at least 40.

8. Reinforcement fiber bundle as in claim 1 and wherein said reinforcement fibers are made of steel with a tensile strength between 500 and 3000 $N/mm^2$.

9. Reinforcement fiber bundle as in claim 1 and wherein said ends of said reinforcement fibers are hook-shaped.

10. Reinforcement fiber bundle as in claim 1 and wherein said bundle comprises end faces, which are substantially evenly covered with said adhering substance.

11. Reinforcement fiber bundle as in claim 9 and wherein substantially only said hook-shaped ends of said reinforcement fibers are comprised in said adhering substance.

12. Method for joining reinforcement fibers to reinforcement fiber bundles for reinforcing a curable material, in which reinforcement fibers are bundled in a substantially parallel position and at least at their ends are joined, comprising the step of joining the reinforcement fibers by applying an adhering substance to at least the ends of the reinforcement fiber bundle, the adhering substance being substantially inert in relation to the non-cured curable material and which substance loses its cohesion under the influence of mechanical forces during the mixing process of the reinforcement fiber bundles with at least the curable material, the adhering substance substantially comprises the curable material, and substantially comprises mortar, concrete, gypsum, cement or a mixture thereof.

13. Method according to claim 12, and wherein the curing adhering substance is applied and then cured.

14. Method according to claim 12 and wherein the substantially parallel bundling of the reinforcement fibers takes place under tension.

15. Reinforcement fiber bundle comprising a number of substantially parallel reinforcement fibers for reinforcing a curable material, which reinforcement fibers are joined at least at the ends thereof by means of an adhering substance which loses its cohesion during the mixing of said reinforcement fiber bundles with at least said curable material wherein said adhering substance comprises secondary reinforcement fibers and said secondary reinforcement fibers comprises at least one of glass fibers and polypropene fibers with a diameter of maximally 100 micrometer.

16. Reinforcement fiber bundle according to claim 15 and wherein said bundle comprises end faces which are substantially evenly covered with said adhering substance.

17. Reinforcement fiber bundle as in claim 15 and wherein said ends of said reinforcement fibers are hook-shaped.

18. Reinforcement fiber bundle according to claim 17 and wherein substantially only said hook-shaped ends of said reinforcement fibers are comprised in said adhering substance.

* * * * *